US008490630B2

(12) United States Patent
Boutros et al.

(10) Patent No.: US 8,490,630 B2
(45) Date of Patent: Jul. 23, 2013

(54) HOOKAH ACCESSORY

(75) Inventors: Daniel Fadi Boutros, San Dimas, CA (US); Saliba Faraj Boutros, San Dimas, CA (US); Haik Kaloutian, Tujunga, CA (US); Artur Gioubalyan, Sunland, CA (US)

(73) Assignee: Daniel Fadi Boutros, San Dimas, CA (US)

( * ) Notice: Subject to any disclaimer, the term of this patent is extended or adjusted under 35 U.S.C. 154(b) by 518 days.

(21) Appl. No.: 12/888,281

(22) Filed: Sep. 22, 2010

(65) Prior Publication Data

US 2012/0067357 A1 Mar. 22, 2012

(51) Int. Cl.
*A24F 5/00* (2006.01)

(52) U.S. Cl.
USPC ..... 131/226

(58) Field of Classification Search
None
See application file for complete search history.

(56) References Cited

U.S. PATENT DOCUMENTS

2007/0056599 A1* 3/2007 Zoumut ..... 131/329

* cited by examiner

*Primary Examiner* — Michael J Felton
(74) *Attorney, Agent, or Firm* — Sam K. Tahmassebi; TechLaw LLP

(57) ABSTRACT

Disclosed herein is a hookah accessory comprising: a top tray configured to hold tobacco; a bottom tray configured to hold hot coal; a hollow tube in fluid communication with the top tray; and attachment means for attaching the accessory to the hookah.

20 Claims, 3 Drawing Sheets

HOOKAH ACCESSORY

FIELD OF THE INVENTION

The present invention is in the field of water pipe accessories (hookahs, nargilieh, argileh, hubbly-bubbly, etc.), and in particular to an accessory that holds the tobacco and the coal.

BACKGROUND OF THE DISCLOSURE

To smoke tobacco using a water pipe, or hookah, the user places tobacco in a bowl on top of the hookah and then places hot coals on top of the tobacco. The coal heats up the tobacco, generating smoke, which is then inhaled through a pipe.

Placing hot coals on top of the tobacco causes the tobacco to burn, rather than cook. The burnt tobacco gives off an unpleasant smoke that masks the flavor of the tobacco and is harsh to the user's palate. It is, therefore, desirable to slowly cook the tobacco. Hookahs presently available cannot accommodate the slow heating of the tobacco.

SUMMARY OF THE INVENTION

Disclosed herein is a hookah accessory comprising: a top tray configured to hold tobacco; a bottom tray configured to hold hot coal; a hollow tube in fluid communication with the top tray; and attachment means for attaching the accessory to the hookah.

Also disclosed herein is a hookah accessory comprising: a top tray configured to hold tobacco; a bottom tray configured to hold hot coal; a rigid hollow tube in fluid communication with the top tray; and attachment means for attaching the accessory to the hookah; where the rigid hollow tube is connected with the attachment means; where the bottom tray is connected to the rigid hollow tube by a cross arm; and where the top tray is attached to the hollow tube.

Further, disclosed herein is a hookah accessory comprising: a top tray configured to hold tobacco; a rigid hollow tube in fluid communication with the top tray; a bottom tray configured to hold hot coal, wherein the bottom tray is connected to the rigid hollow tube by a cross arm; locking means to lock the bottom tray in place on the rigid hollow tube and attachment means for attaching the accessory to the hookah; where the top tray is attached to the hollow tube.

DETAILED DESCRIPTION OF THE EMBODIMENTS

Disclosed herein is a hookah accessory that keeps the hot coal and the tobacco physically separate, but within close proximity, so that the heat of the coal slowly and gently heats the tobacco without burning or charring the tobacco. The slow heating causes flavorful smoke to emanate from the tobacco, without any of the harsh and unpleasant flavors that result when tobacco is burnt.

Figure 1:
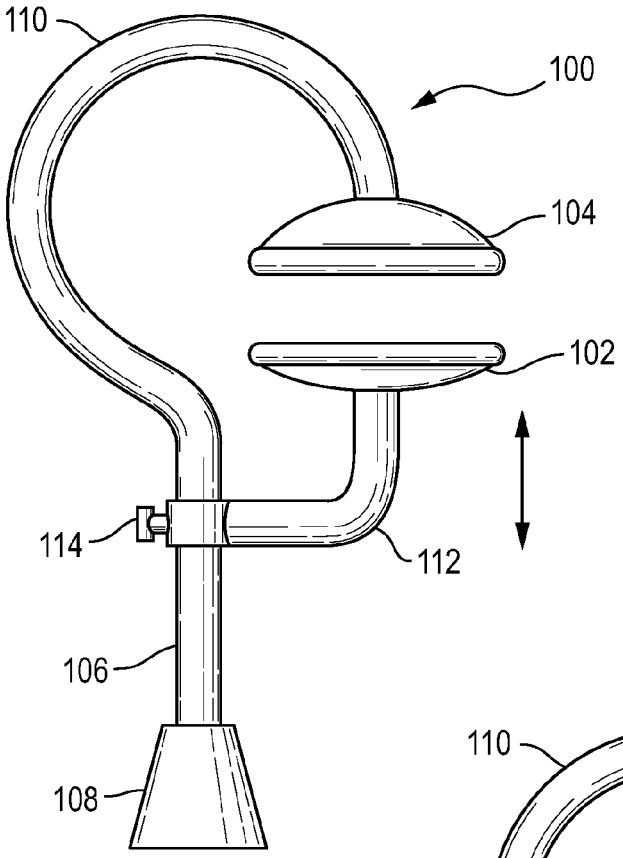
FIG. 1 illustrates one embodiment of the hookah accessory disclosed herein.

Turning to FIG. 1, disclosed is an embodiment of the hookah accessory 100 disclosed herein. The accessory 100 comprises a bottom tray 102 and a top tray 104. The bottom tray 102 is configured to hold the hot coal, whereas the top tray 104 is configured to hold the tobacco. The accessory 100 further comprises a post 106. The post 106 is preferably made of solid material, such as metal. The post 106 holds the accessory 100 upright and all of the other components of the accessory 100 are directly or indirectly connected thereto. The accessory 100 is connected to the hookah through a connection means 108. A pipe 110 is configured to carry the smoke from the top tray 104 to the internal pipes of the hookah, which ultimately carry the smoke to the user.

The bottom tray 102 is intended to hold the hot coal. In the embodiment shown in the figures, the shape of the bottom tray 102 is curved. Those of ordinary skill in the art recognize that the bottom tray 102 can be of any shape suitable for holding hot coals. For example, the tray 102 can be a square with sharp, well-defined edges. Alternatively, tray 102 can be an up-side down cone or pyramid, with the point or apex pointing downward. The utility of the tray 102 is for holding the coal; its particular shape is aesthetically defined.

The bottom tray 102 is connected to the post 106 by arm 112. The position of arm 112 with respect to the post 106 is controlled by lock 114. When lock 114 is loosened, arm 112 can move up and down along post 106. The up and down movement changes the gap between bottom tray 102 and top tray 104. The user can then control the amount of heat applied to the tobacco by bringing the bottom tray 102 closer to or further away from the top tray 104. Heating the tobacco more causes more smoke to be generated, whereas heating the tobacco less causes less, yet more flavorful, smoke to emanate.

Figure 3:
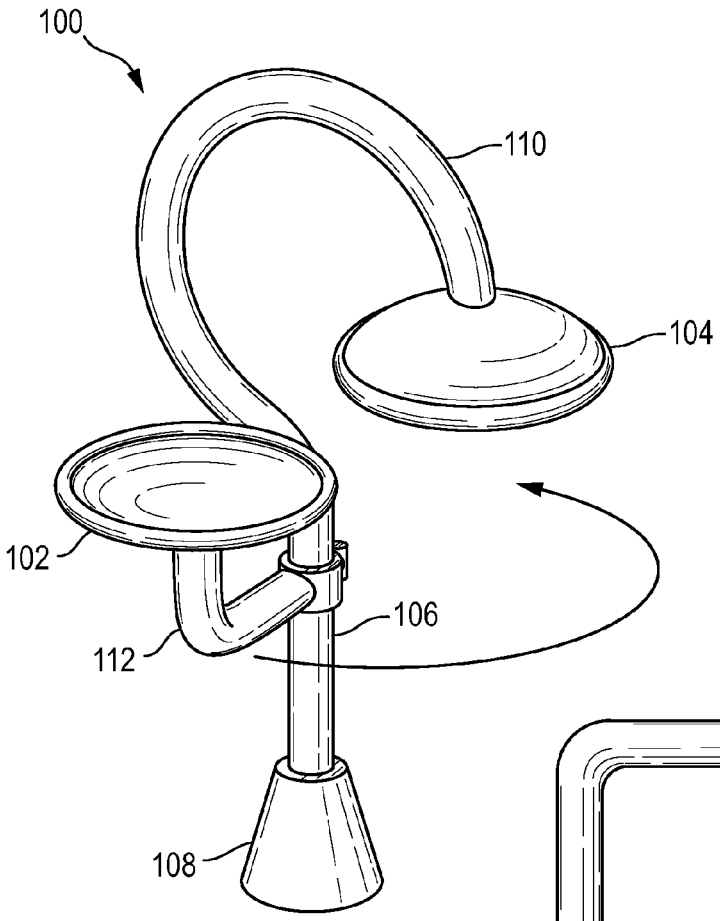
FIG. 3 illustrates the rotation of the bottom tray about the axis of the post or the rigid hollow tube.
Figure 4:
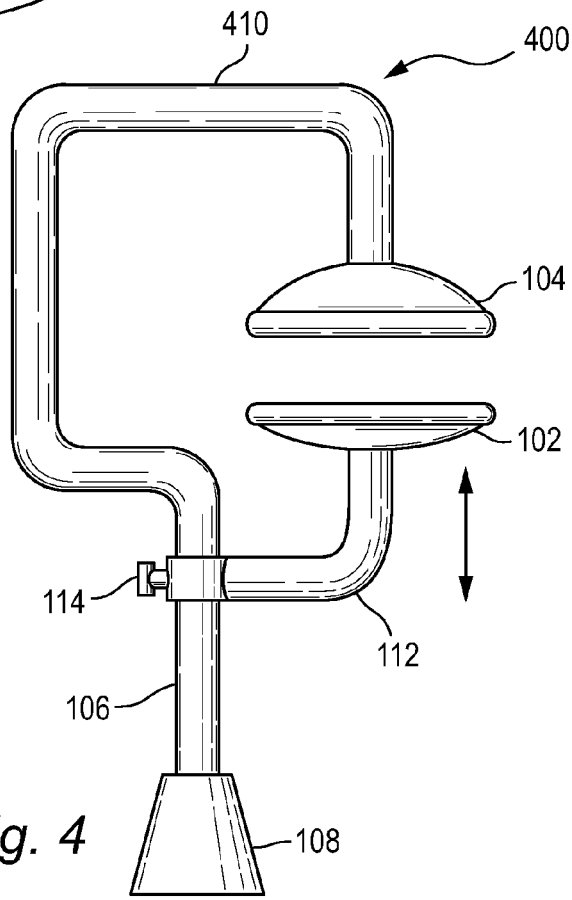
FIG. 4 illustrates one embodiment of the hookah accessory disclosed herein.

As shown in FIG. 3, arm 112 can also rotate radially about post 106. Such rotation allows the user to have access to both trays 102 and 104 in order to place coals and tobacco in the respective trays.

In some embodiments, lock 114 comprises a screw, which when tightened prevents arm 112 to move with respect post 106, but when loosened allows for the movement of arm 112. In other embodiments, lock 114 comprises a friction lock, a locking tab, dent, or other locking mechanisms.

In some embodiments, lock 114 comprises both a lock that immobilizes the arm 112 with respect to the post 106, and a vertical adjustment mechanism. In these embodiments, loosening the lock 114 will not allow the arm 112 to freely move vertically along the post 106. Such free movement may cause the bottom tray assembly (comprising bottom tray 102 and arm 112) to fall unexpectedly and spill the hot coal. Instead, arm 112 can only move vertically when the vertical adjustment mechanism is turned. In some embodiments, the vertical adjustment mechanism comprises a gear that matches teeth on the post 106. Turning the vertical adjustment mechanism causes the gear to move along the teeth and move the arm with respect to.

Figure 2:
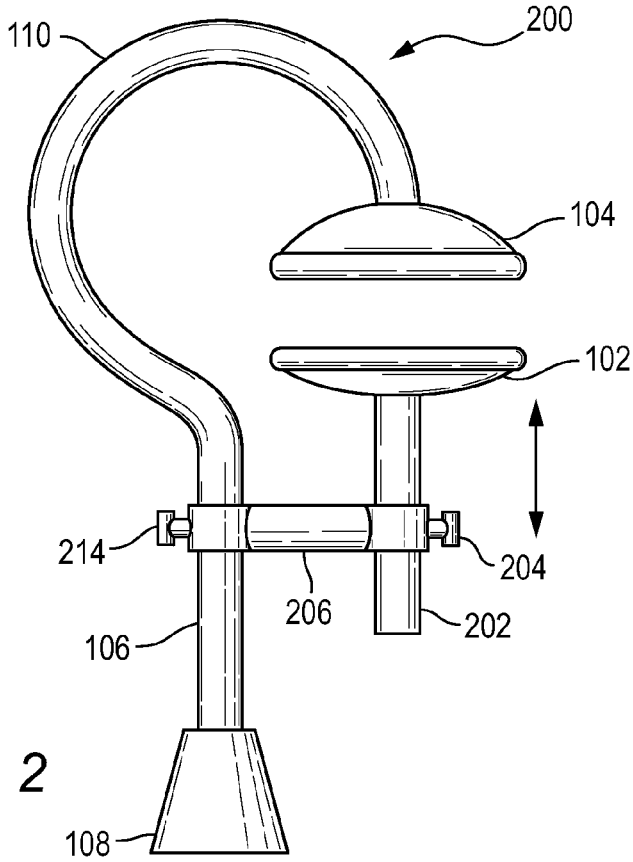
FIG. 2 illustrates one embodiment of the hookah accessory disclosed herein.

In some embodiments, such as the accessory 200 shown in FIG. 2, bottom tray 102 is attached to a tray post 202, which in turn is connected to the post 106 by cross arm 206. Thus, in these embodiments, the arm 112 is broken down into two separate components, the vertical tray post 202 and the horizontal cross arm 206. The lock 204 controls the vertical position of tray 102 whereas the lock 214 controls the radial rotation of the bottom tray assembly (comprising tray 102, post 202, and cross arm 206) about the post 106 axis.

In some embodiments, lock 214 also controls the vertical position of the bottom tray assembly. In some of these embodiments, lock 214 is used for the coarse adjustment of the height, whereas lock 204 is used for the fine adjustment.

The hookah accessory disclosed herein also comprises a pipe 110, which is configured to transport smoke from the top tray 104 to the hookah for the enjoyment of the user. In some of the embodiments, such as the accessories 100, 200, and 400, shown in the FIGS. 1-4, pipe 110 is a solid pipe and pipe 110 and the post 106 are connected as one contiguous hollow solid pipe. In these embodiments, when the accessory, e.g., 100, is connected to the hookah through the connection 108, described below, the pipe 110 will be in fluid communication with the hookah's mouthpiece. When the user sucks on the mouthpiece, smoke will travel from the tobacco in top tray 104 through pipe 110, through post 106, through the internal pipes of the hookah, and will ultimately reach the mouthpiece and the user.

The shape of the pipe 110 has no functional utility and is purely aesthetic. For example, in FIG. 1, pipe 110 is depicted as being curved, whereas in FIG. 4, pipe 110 is square and has 90° bends. Pipe 110 can take on any other shape, for example triangular, elliptical, and the like.

In other embodiments, pipe 110 is not a solid piece. In these non-illustrated embodiments, top tray 104 is connected to post 106 by a cross arm. A malleable pipe, such as one made of plastic, fluoropolymer (such as Tygon® tubes), rubber, and the like, connects top tray 104 with the internal tubes of the hookah and provides the fluid communication between the top tray 104 and the mouthpiece.

The accessory 100 is connected to a hookah through the connection 108. In some embodiments, the post 106 continues through the connection 108, such that when the accessory is connected to the hookah, fluid communication is established between post 106 and the hookah. In some embodiments, the connection 108 is a push-fit connection that holds the accessory 100 in place by friction grip. In other embodiments, the connection 108 screws on the tip of the hookah. In yet other embodiments, the connection 108 comprises a screw knob that when tightened, holds the accessory 100 in place. In still other embodiments, the connection 108 comprises a locking tab, dent, or other locking mechanisms.

Figure 8:
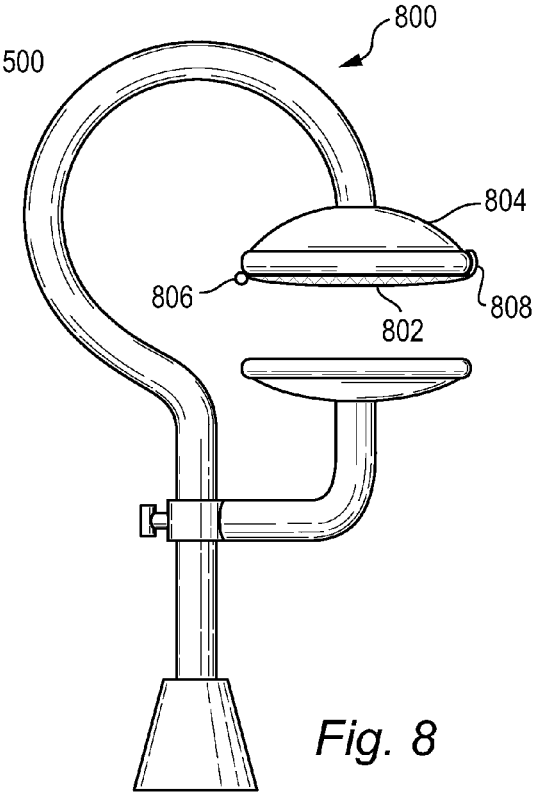
FIG. 8 illustrates one embodiment of the hookah accessory disclosed herein with a mesh covering for the top tray.

Top tray 104 is configured to hold tobacco. In some embodiments, tobacco is placed in the top tray 104 and then is covered with a metal foil, such as aluminum foil, such that the foil keeps the tobacco in place. In other embodiments, for example the accessory 800 shown in FIG. 8, a mesh screen 802 is provided that covers the tobacco. In some of these embodiments, the mesh screen 802 is connected to the top tray 804 by a hinge 804 and a lock 806. The user unlocks the lock 806 and the mesh screen 802 hinges open providing access to the top tray 804 and allowing the user to place the tobacco therein. The user then hinges the mesh screen 802 closed, thereby enclosing the tobacco within the hollow space of the top tray 804. After use, the user can then re-open the mesh screen 802 and discard the used tobacco. In other embodiments, not shown, the mesh screen 802 has no hinge and simple snaps over the opening of the top tray 804 to keep the tobacco from falling out.

Figure 5:
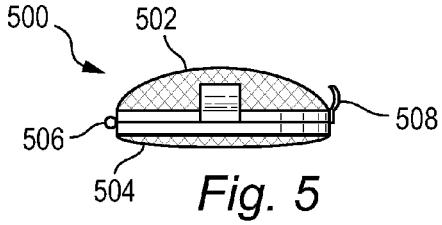
FIG. 5 illustrates one embodiment of the tobacco container disclosed herein in its closed position.
Figure 6:
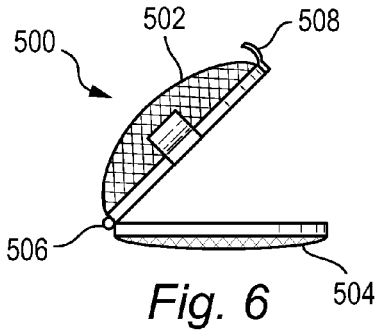
FIG. 6 illustrates the tobacco container of FIG. 5 in its open position.
Figure 7:
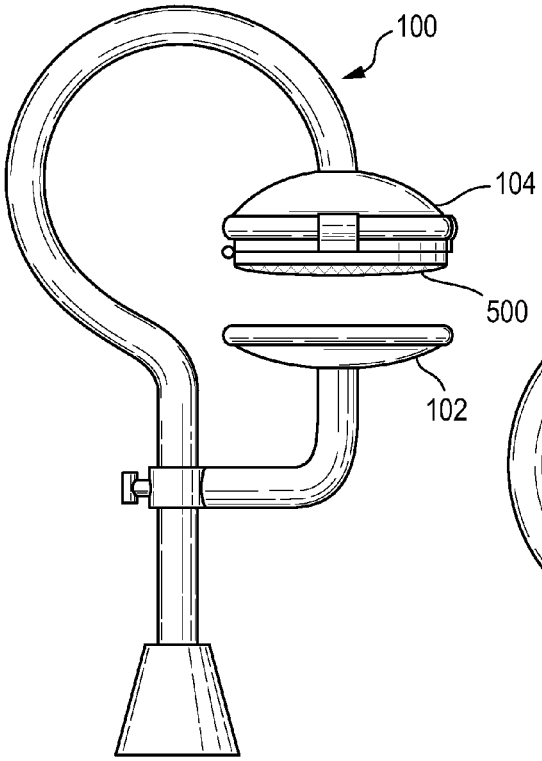
FIG. 7 illustrates one embodiment of the hookah accessory disclosed herein with the attached tobacco container of FIG. 5.

In yet other embodiments, provided herein is a container 500 for holding the tobacco, as shown in FIGS. 5 and 6. The container 500 comprises of a top part 502 and a bottom part 504. In some embodiments, the top and bottom parts, 502 and 504, are connected by hinge 506 at one end. The top part 502 opens and closes about the hinge 506 and, once closed, can be locked in place using a locking mechanism 508. The locking mechanism can be a friction lock, a snap lock, or any other suitable locking mechanism. The container 500, once closed, is configured to fit within the hollow space of the top tray 104, as shown in FIG. 7. In some embodiments, the container 500 simply snaps in place in top tray 104. The user opens the container 500, places tobacco therein, closes it, and then snaps it in place in top tray 104.

In other embodiments, container 500 cannot be opened by the user. In these embodiments, the manufacturer places the tobacco within the container 500 and seals the edge between the top and bottom parts, 502 and 504, and provides the pre-loaded container 500 to the user. After use, the user simply discards the used container 500 and replaces it with a fresh one.

In some embodiments, container 500 is made up of a metallic mesh. The mesh bottom part 504 allows for the heat of the coal to reach the tobacco, while the mesh top part 502 allows for the smoke to reach the pipe 110. In other embodiments, the bottom part 504 is solid. In these embodiments, the solid metal bottom part 504 is able to evenly distribute the heat of the coals over its surface and thereby evenly heat the tobacco. In these embodiments, the solid metal bottom part 504 still comprises holes for air to flow through the tobacco to carry the smoke to the hookah's mouthpiece.

Therefore, to use the accessory 100 disclosed herein, the user rotates the bottom part 102 out of the way. The user then places tobacco in the top part 104 by any of the means described herein. The user then places the accessory on top of a hookah and then places hot coals in the bottom part 102. The user then rotates the bottom part 102 to be directly under the top part 104 and then adjusts the height of the bottom part 102 to place the coals at a desired distance away from the tobacco. As more of the tobacco is smoked and the coals get cooler, the user can adjust the height of the bottom part 102 to bring the coals closer to the remaining tobacco.

In another aspect, disclosed herein is hookah, to which one of the accessories 100, 200, 400, or 800, as described above is attached. In some embodiments, the aforesaid accessories are permanently affixed to the hookah, while in other embodiments, the aforesaid accessories can be easily removed from the hookah and be replaced by another like accessory or by a traditional holder for tobacco and coal.

Throughout this disclosure, a particular element is described in terms of one of the illustrated hookah accessories, e.g., the accessory 100. It is understood that such description equally applies where the same element appears for the other illustrated hookah accessories, e.g., the accessories 200 and 400, or for any accessory not illustrated but falling within the scope of the present disclosure and/or its claims.

What is claimed is:

1. A hookah accessory comprising:

a top tray configured to hold tobacco;

a bottom tray configured to hold hot coal;

a hollow tube in fluid communication with the top tray; and attachment means for attaching the accessory to the hookah.

2. The accessory of claim 1, further comprising a post, wherein the bottom tray is connected to the post by a cross arm.

3. The accessory of claim 2, wherein the post is in fluid communication with the hollow tube.

4. The accessory of claim 2, further comprising first locking means to lock the bottom tray in place on the post.

5. The accessory of claim 4, wherein the bottom tray is configured to move up and down along the post and turn radially around the axis of the post.

6. The accessory of claim 1, wherein the hollow tube is in fluid communication with the attachment means, such that when the accessory is attached to a hookah, the hollow tube is in fluid communication with the hookah.

7. The accessory of claim 2, wherein the post is connected to the attachment means.

8. The accessory of claim 2, wherein the hollow tube is contiguous with the post.

9. The accessory of claim 1, wherein the top tray is attached to the hollow tube.

10. The accessory of claim 1, wherein the hollow tube is rigid.

11. The accessory of claim 1, further comprising a mesh screen connected to the top tray, wherein the mesh screen is configured to hold the contents of the top tray in place.

12. The accessory of claim 11, wherein the mesh screen opens about a hinge.

13. A hookah accessory comprising:

a top tray configured to hold tobacco;

a bottom tray configured to hold hot coal;

a rigid hollow tube in fluid communication with the top tray; and attachment means for attaching the accessory to the hookah;

wherein the rigid hollow tube is connected with the attachment means;

wherein the bottom tray is connected to the rigid hollow tube by a cross arm; and wherein the top tray is attached to the hollow tube.

14. The accessory of claim 13, further comprising first locking means to lock the bottom tray in place on the rigid hollow tube.

15. The accessory of claim 14, wherein the bottom tray is configured to move up and down along the rigid hollow tube and turn radially around the axis of the rigid hollow tube.

16. The accessory of claim 15, wherein the rigid hollow tube is in fluid communication with the attachment means, such that when the accessory is attached to a hookah, the rigid hollow tube is in fluid communication with the hookah.

17. The accessory of claim 16, wherein the bottom tray is connected to a post and the post is connected to the cross arm.

18. The accessory of claim 17, further comprising a second locking means to lock the bottom tray in place on the post.

19. The accessory of claim 18, wherein the first locking mechanism is configured to allow the cross arm to turn radially about the axis of the rigid hollow tube, and the second locking mechanism is configured to allow the bottom tray to move up and down with respect to the cross arm.

20. A hookah accessory comprising:

a top tray configured to hold tobacco;

a rigid hollow tube in fluid communication with the top tray;

a bottom tray configured to hold hot coal, wherein the bottom tray is connected to the rigid hollow tube by a cross arm;

locking means to lock the bottom tray in place on the rigid hollow tube and attachment means for attaching the accessory to the hookah;

wherein the top tray is attached to the hollow tube.

* * * * *